United States Patent [19]

Bokich

[11] Patent Number: 4,862,539

[45] Date of Patent: Sep. 5, 1989

[54] RESILIENT STRUCTURE

[76] Inventor: Robb B. Bokich, 1851 River Rd., Eugene, Oreg. 97401

[21] Appl. No.: 257,703

[22] Filed: Oct. 14, 1988

Related U.S. Application Data

[63] Continuation of Ser. No. 48,231, May 11, 1987, abandoned.

[51] Int. Cl.[4] ..... A47C 27/14; A47C 27/15

[52] U.S. Cl. ..... 5/473; 5/448; 5/481; 428/71

[58] Field of Search ..... 5/481, 448, 461, 470, 5/473, 484, 496, 498; 297/DIG. 1; 428/71

[56] References Cited

U.S. PATENT DOCUMENTS

| | | | |
|---|---|---|---|
| 2,147,362 | 2/1939 | Bloomberg | 5/481 |
| 3,900,648 | 8/1975 | Smith | 428/71 |
| 3,965,506 | 6/1976 | Marks | 5/481 |
| 4,109,332 | 8/1978 | Lück | 5/481 |
| 4,222,302 | 9/1980 | Hampton et al. | 24/204 |
| 4,336,621 | 6/1982 | Schwartz et al. | 5/465 |

FOREIGN PATENT DOCUMENTS

| | | | |
|---|---|---|---|
| 977872 | 12/1964 | United Kingdom | 5/481 |

*Primary Examiner*—Alexander Grosz

*Attorney, Agent, or Firm*—James D. Givnan, Jr.

[57] ABSTRACT

A resilient article includes an enclosure extending about a filler material of resilient foam pieces. The pieces have multiple, distinct surfaces defined by angular edges with the surfaces and edges of adjacent pieces cooperating to inhibit movement between the pieces to prevent packing which would utlimately cause a reduction in the resiliency of the article.

3 Claims, 1 Drawing Sheet

RESILIENT STRUCTURE

This is continuation of application Ser. No. 07/048,231 filed May 11, 1987 now abandoned.

BACKGROUND OF THE INVENTION

The present invention pertains generally to structures of a resilient nature for supporting the human body.

In the known prior art various types of cushions, pads, etc., for supporting the human body in sitting or reclininig positions. The primary objective of such pads used in hospitals and nursing homes is the relieving of compression of certain areas of the body to prevent or alleviate bed sores. One commonly used cushion is of a shape resembling that of an egg crate to the extent such cushions are termed egg crate cushion in the medical and nursing fields. A problem of such cushions is the deterioration of the foam material and its susceptibility to contamination from incontinent users. Thirdly, such pillows do not adequately support the body in the optimum means but rather have spaced apart support projections resulting in compression of body tissue at certain locations.

A further drawback to the above described cushion is cost as the cushion must be replaced several times in a year with normal use.

Filler formed by the chopping, crushing or grinding of foam material results in small filler pieces which are susceptible to packing.

SUMMARY OF THE PRESENT INVENTION

The present invention is embodied in a resilient structure having a multitude of randomly orientated pieces of differing three dimensional shapes.

The filler of the present structure is pieces of foam material formed with surface areas which are conducive to retentive abutment with adjacent filler pieces to resist packing as occur with pieces of filler material having curved surface areas. The pieces of the present filler tend to adhere to one another by reasons of edge-to-surface engagement between two adjacent pieces. Heretofore the repeated loading of a cushion with discrete filler resulted in the nesting or packing of the filler to eventually reduce article resiliency. Curved surfaces on filler pieces contributes to such packing.

Formation of the present filler pieces is accomplished in a manner resulting in flat or near flat surfaces of the filler pieces along one or both axes of each surface. Such flat or gently curved surfaces of the pieces result in the pieces frictionally adhering to one another even during compression of the pillow, pad, etc. Angular edges of the filler pieces contribute to maintaining this desirable relationship between adjacent pieces.

Important objectives of the present resilient structure include the provision of a structure for placement on a rigid or yieldable surface to provide cushioning for the human body to distribute support over a large area of the body to prevent bed sores which result from protracted compression of body tissue; the provision of a resilient structure that may be shaped to a degree to provide optimum support of a body member; the provision of a resilient structure that is not easily contaminated yet is open to the passage of air; the provision of a resilient structure with strap means for securement to a supporting structure such as a mattress, chair seat, auto seat, etc.; the provision of a resilient structure having a filler material which resists packing after long use and hence retains its resiliency as opposed to known articles in which the quantity of filler material tends to "shrink" by reason of compaction

DETAILED DESCRIPTION OF THE PREFERRED EMBODIMENTS

Figure 1:
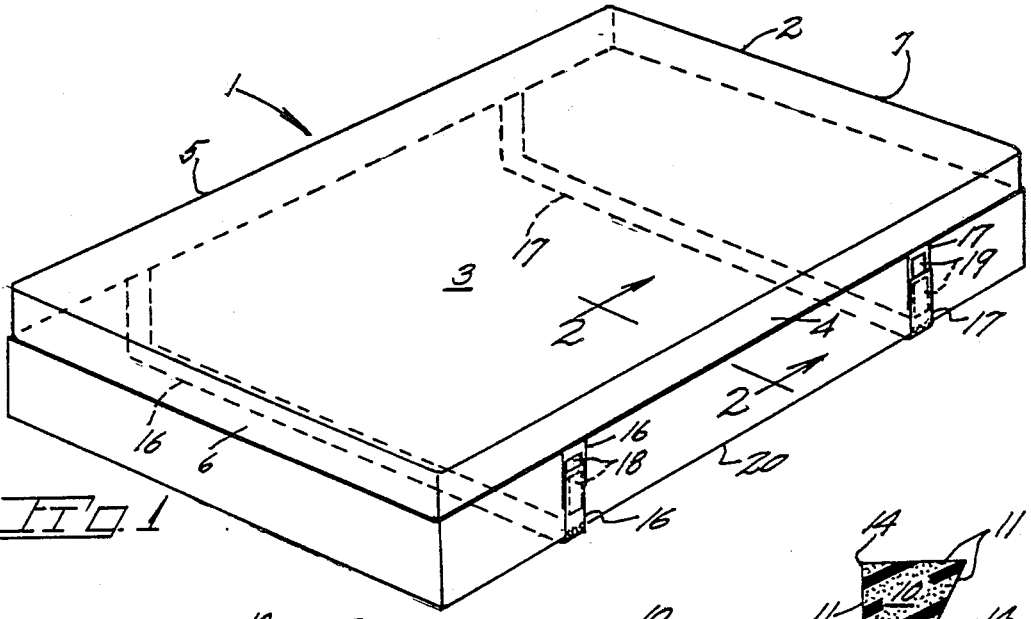
FIG. 1 is a perspective view of the present resilient structure in place on a mattress.

With continuing attention to the drawings wherein applied reference numerals indicate parts similarly hereinafter identified, the reference numeral 1 indicates generally a resilient structure, shown as a mattress covering or pad but which may be embodied in a wide range of structures for use on seats, chairs, wheelchairs, etc., upon external dimensional changes.

The structure includes a cover 2 which includes a moisture impervious upper member 3 with side members 4, 5, 6 and 7. It is desirable that upper member 3 and the side members be seamless to constitute a moisture barrier. A bottom member at 8 is preferably of ticking pervious to air passage and joined by a seam 9 at the side members.

The filler at 10 is of a discrete nature being foam pieces having somewhat elongate surfaces 11 which are flat or slightly curved along one axis and extend intermediate surfaces 12 of lesser size. The pieces are primarily elongate with surfaces well defined by edges as at 14 which are of an angular nature.

Figure 2:
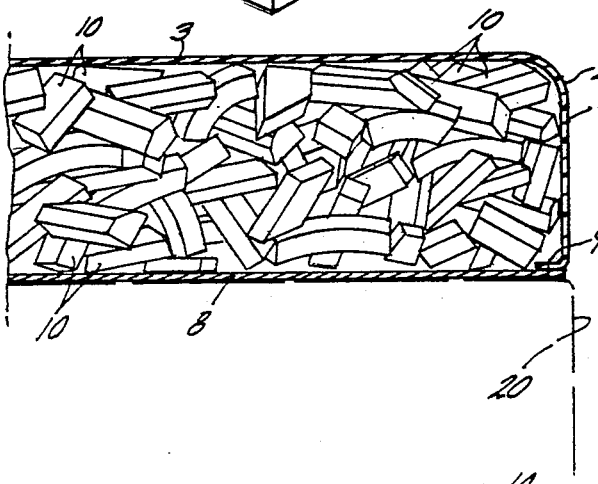
FIG. 2 is a vertical sectional view taken along line 2—2 of FIG. 1.

One suitable material for the filler is polyurethane cut from sheet stock by a shearing action which occurs as the sheet is fed lengthwise into a machine having a rotating cutter member equipped with blades. Accordingly tapered or feather edges are avoided. As shown in FIG. 2, the pieces constituting the filler are in random orientation in the resilient structure. Importantly, the pieces interact with one another in an unexpected manner to retain such orientation. The essentially flat surfaces 11, the angular edges 14 along with the highly frictional nature of the foam results in the pieces returning to their earlier relationship to one another even after a lengthy period of use. The cut or sheared surfaces of the pieces have a fibrous surface, when viewed through a magnifying lens, which resists movement along a surface of an adjacent piece.

Figure 4:
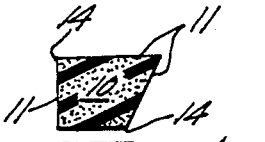
FIGS. 4, 5 and 6 are sectional views taken along lines 4—4, 5—5 and 6—6 of FIG. 3.
Figure 5:
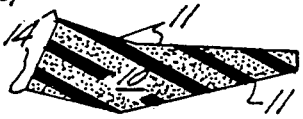
Figure 6:
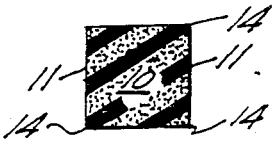
Figure 3:
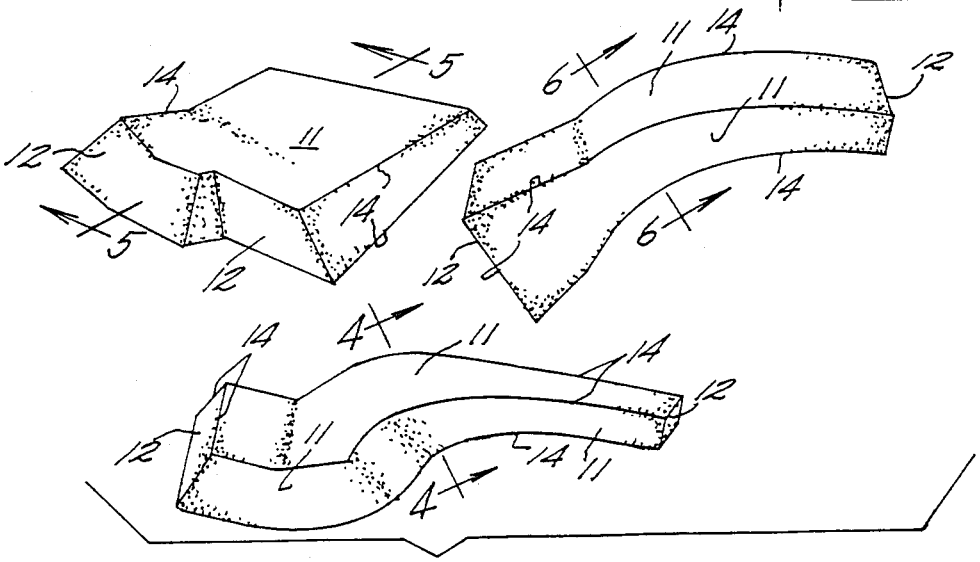
FIG. 3 is a perspective view of typical pieces of filler.

With attention to FIG. 3, the sample pieces of filler shown in perspective are meant to be typical of other pieces with surfaces 11 being flat or curved along one axis of the surface resulting in the polygonal sections viewed in FIGS. 4, 5 and 6.

For securement of the resilient structure to a supporting surface in a removable manner pairs of straps at 16—16 and 17—17 are provided. The straps are attached to the structure at a seam 9 and include fabric closure strips at 18 and 19 for convenient joining of the strap ends. A support structure at 20 is a mattress but may of course be a chair cushion or the like.

Of importance to those using the present resilient structure is the feature that it may be given shape to some extent by forcefully manually impacting a surface of the structure. For example, in a resilient pad structure a raised area may be formed for elevation of the head or a leg or arm member by repeated impacting of the pad surfaces adjacent the pad surface to be elevated. Return of the structure to a more or less flat configuration occurs upon forcefully patting the raised area.

The present filler is made by directing sheets of foam material preferably two or three inches thick through a rotary cutter having a multitude of staggered, U-shaped blades. Compression of the material during passage of the blades therethrough causes the cut pieces to have the irregular surfaces above described. The foam sheet is fed into the cutter through a pair of feed wheels which act to control the speed of the sheet into the cutter.

While I have shown but one embodiment of the invention, it will be apparent to those skilled in the art that the invention may be embodied still otherwise without departing from the spirit and scope of the invention.

Having thus described the invention, what is desired to be secured in a Letters Patent is:

1. A resilient structure for placement on a bed or chair to provide a cushion for the human body; said structure comprising, a cover including a moisture impervious upper member and moisture impervious side members merging into said upper member, a bottom member of a permeable nature attached to said side members, a seam joining said side members to said bottom member, strap means attached to said side members and adapted to pass below a portion of the bed or chair and provided with closure means, and a filler comprised of discrete randomly foam pieces of oriented elongate differing shapes, said pieces each having multiple elongate surfaces, some of said surfaces of each piece being slightly curved along one axis, angular edges defining said multiple surfaces, said elongate surface being of a fibrous nature to promote cohesion of the pieces to one another and resist packing of same.

2. The resilient structure claimed in claim 1 wherein said pieces are cut from sheet stock of approximately two to three inch thickness.

3. The resilient structure claimed in claim 1 wherein said pieces are of polyurethane foam.

* * * * *